US009828123B2

(12) United States Patent
Taghipour

(10) Patent No.: US 9,828,123 B2
(45) Date of Patent: Nov. 28, 2017

(54) TRAY-SEALING MACHINE WITH MONITORING DEVICE AND METHOD

(71) Applicant: MULTIVAC SEPP HAGGENMÜLLER GMBH & CO. KG, Wolfertschwenden (DE)

(72) Inventor: Alireza Taghipour, Kempten (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 807 days.

(21) Appl. No.: 14/137,122

(22) Filed: Dec. 20, 2013

(65) Prior Publication Data

US 2014/0182245 A1 Jul. 3, 2014

(30) Foreign Application Priority Data

Dec. 27, 2012 (EP) ..... 12008636

(51) Int. Cl.
*B65B 7/28* (2006.01)
*B65B 57/10* (2006.01)
*B65B 9/04* (2006.01)

(52) U.S. Cl.
CPC ..... *B65B 7/28* (2013.01); *B65B 9/04* (2013.01); *B65B 57/10* (2013.01)

(58) Field of Classification Search
CPC .. B65B 57/10; B65B 7/28; B65B 9/04; B65B 7/164; B65B 7/2878; B65B 57/02; G01N 21/88; G01N 21/9018; G01N 21/9027; G01N 21/9036; G01N 2021/8841
USPC ..... 53/287, 396, 52, 53, 54, 329.2–329.5; 356/237.1, 240.1; 250/559.01–559.49, 250/221, 548; 340/555, 556
See application file for complete search history.

(56) References Cited

U.S. PATENT DOCUMENTS 4,691,231 A * 9/1987 Fitzmorris ..... B07C 5/3408 209/522
4,848,912 A * 7/1989 Sano ..... G01B 11/245 356/244
5,331,118 A * 7/1994 Jensen ..... G01B 11/00 177/245

(Continued)

FOREIGN PATENT DOCUMENTS

EP 1988024 A1 11/2008
EP 2036817 A1 3/2009
EP 2206653 A1 7/2010

OTHER PUBLICATIONS

Invoice No. 5307 from CFS North America Inc. to Cargill Meat Solutions, Jul. 8, 2010, 1 page, Kempten, Germany; provided to Applicant in connection with Opposition Brief for European Patent No. EP2749500 filed by GEA Food Solutions Germany GmbH on Nov. 10, 2015; no other information known nor has this been verified as prior art in the U.S.

(Continued)

*Primary Examiner* — Hemant M Desai
*Assistant Examiner* — Valentin Neacsu
(74) *Attorney, Agent, or Firm* — Husch Blackwell LLP

(57) ABSTRACT

The invention relates to a tray-sealing machine with a control unit and a matrix monitoring device for detecting a misalignment of a tray in a sealing tool bottom part and/or the presence of foreign matter between the sealing tool bottom part and a sealing tool upper part, and for distinguishing this from product projecting from the tray.

8 Claims, 2 Drawing Sheets

(56) References Cited

U.S. PATENT DOCUMENTS 5,369,713 A * 11/1994 Schwartz ..... B07C 5/3408 348/86
5,501,571 A * 3/1996 Van Durrett ..... B65G 61/00 414/21
5,523,560 A * 6/1996 Manique ..... G01N 21/9027 209/526
5,644,895 A * 7/1997 Edwards ..... B29C 65/18 53/55
5,732,529 A * 3/1998 Dey ..... B65H 23/0326 53/389.2
5,848,514 A * 12/1998 Edwards ..... B29C 65/18 53/249
6,937,339 B2 * 8/2005 Yamazaki ..... G01N 21/9027 356/239.6
7,278,323 B2 * 10/2007 Hartmann ..... G01B 11/245 356/138
2002/0125450 A1 * 9/2002 Gochar, Jr. ..... G01N 21/95 250/559.45
2003/0079619 A1 * 5/2003 Comley ..... B30B 15/028 100/38
2006/0144158 A1 * 7/2006 Hartmann ..... G01B 11/245 73/761
2006/0289752 A1 * 12/2006 Fukunishi ..... H01J 37/28 250/310
2007/0164222 A1 * 7/2007 Biel ..... B65B 25/008 250/358.1
2009/0010386 A1 * 1/2009 Peschmann ..... G01N 23/223 378/57
2010/0115887 A1 * 5/2010 Schroeder ..... B07C 5/3404 53/396
2010/0141961 A1 * 6/2010 Knobel ..... G01B 11/2433 356/612
2010/0170205 A1 * 7/2010 Mayer ..... B65B 57/16 53/476
2011/0005171 A1 * 1/2011 Woerz ..... B65G 47/086 53/448
2012/0105623 A1 * 5/2012 Pauli ..... F01L 3/24 348/92

OTHER PUBLICATIONS

Machine Order (Maschinenauftrag TwinStar) from CFS North America to Cargill, Jan. 22, 2010, 1 page; provided to Applicant in connection with Opposition Brief for European Patent No. EP2749500 filed by GEA Food Solutions Germany GmbH on Nov. 10, 2015; no other information known nor has this been verified as prior art in the U.S.

Contract Data Sheet (MasterPlanning GEA FS—Kempten) from GEA Food Solutions North America, Inc. to Cargill CVAM, 1 page; provided to Applicant in connection with Opposition Brief for European Patent No. EP2749500 filed by GEA Food Solutions Germany GmbH on Nov. 10, 2015; no other information known nor has this been verified as prior art in the U.S.

Operation Manual TwinStar (Funktionsbeschreibung), p. 41; provided to Applicant in connection with Opposition Brief for European Patent No. EP2749500 filed by GEA Food Solutions Germany GmbH on Nov. 10, 2015; no other information known nor has this been verified as prior art in the U.S.

Photos of the monitoring device, 5 pages; provided to Applicant in connection with Opposition Brief for European Patent No. EP2749500 filed by GEA Food Solutions Germany GmbH on Nov. 10, 2015; no other information known nor has this been verified as prior art in the U.S.

CFS Handover Certificate, executed Jan. 5, 2011, 3 pages; provided to Applicant in connection with Opposition Brief for European Patent No. EP2749500 filed by GEA Food Solutions Germany GmbH on Nov. 10, 2015; no other information known nor has this been verified as prior art in the U.S.

* cited by examiner

TRAY-SEALING MACHINE WITH MONITORING DEVICE AND METHOD

CROSS-REFERENCE TO RELATED APPLICATIONS

This Application claims priority to European Application Number 12008636.8 filed Dec. 27, 2012, to Alireza Taghipour, currently pending, the entire disclosure of which is incorporated herein by reference.

FIELD OF THE INVENTION

The invention relates to a packaging machine and to a method of operating a tray-sealing machine.

BACKGROUND OF THE INVENTION

From EP 1 988 024, a monitoring system for a tray-sealing machine is known for detecting a misalignment of a tray in a sealing tool bottom part or foreign matter between the sealing tool bottom part and the sealing tool upper part to prevent defective sealing or damage to the tools.

A tray-sealing machine with such monitoring system is not able to pack products when the product projects beyond the tray's edge or the tray as this part of the product is interpreted and evaluated as foreign matter. As a consequence, the machine will stop with a corresponding error message.

SUMMARY OF THE INVENTION

It is the object of the present invention to improve a monitoring system for detecting a misalignment of trays and/or foreign matters for a tray sealing machine such that packages with projecting products may be produced.

The tray-sealing machine according to one embodiment of the present invention with a sealing device which seals a film onto a tray, where the sealing device comprises a sealing tool upper part and a sealing tool bottom part, is characterized in that a matrix monitoring device is provided which comprises first and second monitoring means, the first monitoring means being provided at a transverse side of the sealing device, and the second monitoring means being provided at a longitudinal side of the sealing device, and the matrix monitoring device being configured to detect a misalignment of the tray in the sealing tool bottom part and/or a presence of foreign matter between the sealing tool bottom part and the sealing tool upper part and to distinguish the same from product projecting upwards from the tray. Thus, even products projecting from the tray's edge to the top may be packed without erroneously triggering a false alarm or a machine stop.

Both monitoring means may be designed as light curtain or camera to be able to monitor one complete width and one complete length of a defined area on a plane that is disposed between the sealing tool bottom part and-the sealing tool upper part.

A defined area on a plane can be provided which may be monitored by means of the matrix monitoring device. The defined area on the plane may be provided underneath the sealing tool upper part. Thus, monitoring may also be effected directly underneath the sealing tool upper part or the film.

In one embodiment, the control unit is configured to stop a lifting motion of the sealing tool bottom part towards the sealing tool upper part in case of an error analysis in the control unit to avoid any damage to the sealing tools or the package itself.

Recipes with data of the position of the trays may be stored in the control unit to either be able to specify an evaluation via the monitoring means in zones or permit a comparison of the detected elements with the data in the control unit to cut out projecting products.

The method according to one embodiment of the present invention for operating a tray-sealing machine, where a misalignment of a tray in the sealing tool bottom part and/or a presence of foreign matter between the sealing tool bottom part and a sealing tool upper part are detected, is characterized in that, by means of a matrix monitoring device and a control unit, a distinction may be made between the misalignment of the tray and/or the presence of foreign matter and a product projecting upwards from the tray. Thus, products that project upwards from the tray's edge may be packed and other causes of errors that were already mentioned may still be detected and addressed.

Preferably, the matrix monitoring device monitors a region between the sealing tool bottom part and the sealing tool upper part in a production direction by means of a first monitoring means, and the region between the sealing tool bottom part and the sealing tool upper part transverse to the production direction by means of a second monitoring means, and the control unit evaluates the monitoring means. Via data stored in the control unit and describing the position of the trays in the sealing tool bottom part, the control unit may make a distinction indicating whether the product detected via the monitoring means is a product in the tray that regularly projects upwards and no machine stop must be initiated as a consequence.

In one embodiment, the matrix monitoring device monitors a defined area on a plane underneath the sealing tool upper part and above the sealing tool bottom part, the defined area on the plane being oriented orthogonally to the lifting motion of the sealing tool bottom part.

The detection of a misalignment and/or presence of foreign matter and the distinction from a projecting product may be carried out during the lifting motion of the sealing tool bottom part towards the sealing tool upper part since the trays are located in the sealing tool bottom part and the lifting motion itself may still cause a change, for example a correction of the position of the tray in the sealing tool bottom part.

The control unit which cooperates with the matrix monitoring device may stop the lifting motion of the sealing tool bottom part to the top after having detected a misalignment and/or the presence of foreign matter and indicates to an operator the cause for the error by means of a display.

The control unit may evaluate partial areas within the defined area on the plane with reference to data on the position of the trays in the sealing tool bottom part stored in the control unit, the partial areas being disposed outside the trays. However, the partial areas preferably still include the tray's edge, so that only the region provided for the product is cut out of the defined area. Since here, only the regions outside the trays are detected, the products projecting upwards in the tray are not detected, but only foreign matter outside or on the tray's edge, or misaligned trays are detected. A subsequent comparison with data in the control unit may be eliminated. This thus reduces the evaluation time for detecting errors.

Other and further objects of the invention, together with the features of novelty appurtenant thereto, will appear in the course of the following description.

DESCRIPTION OF THE SEVERAL VIEWS OF THE DRAWING

Below, an advantageous embodiment of the invention will be illustrated more in detail with reference to a drawing. The figures show in detail.

Equal components are always provided with the same reference numerals in the figures.

DETAILED DESCRIPTION OF THE INVENTION

Figure 1:
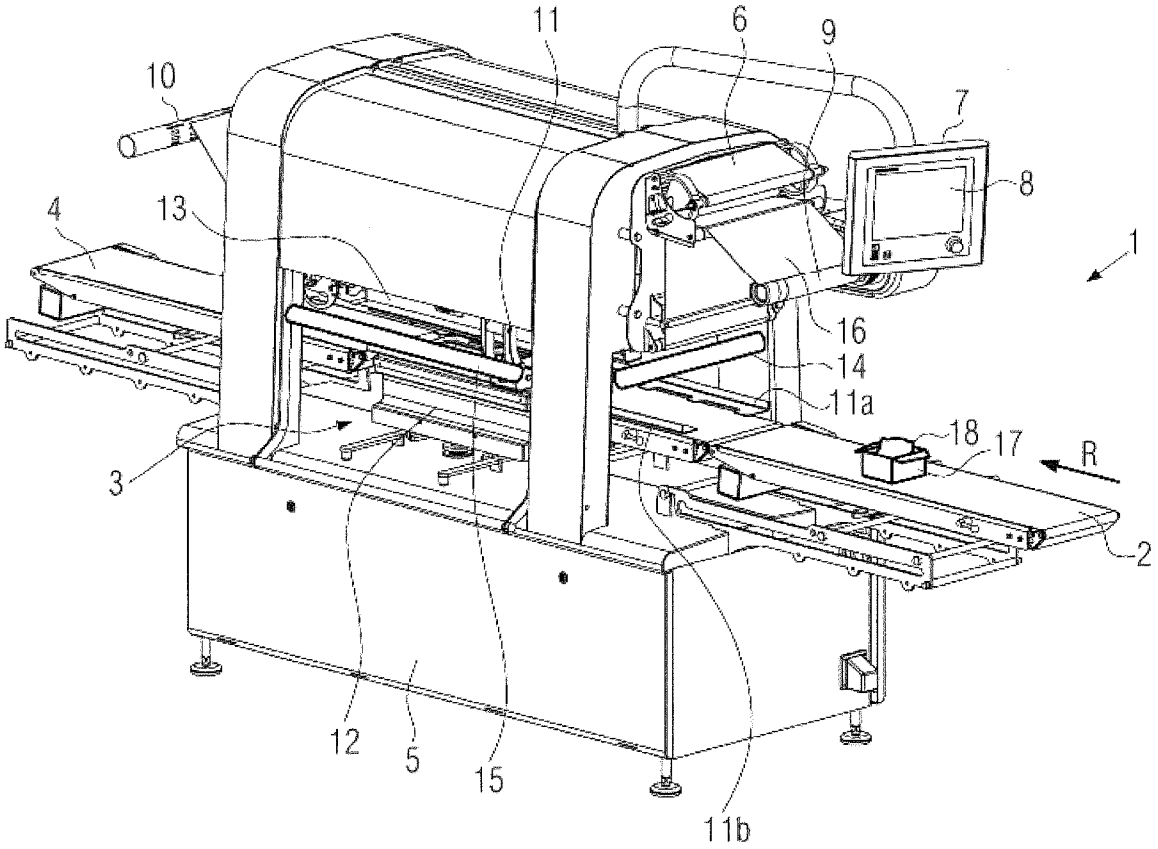
FIG. 1 is a side perspective view of a tray-sealing machine according to one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a tray-sealing machine 1 with a feed belt 2, a sealing device 3, a discharge belt 4, a machine frame 5, a film tensioning device 6, a control unit 7 with an operating device and a display 8, a film feed roller 9, a residual film rewinder 10 and a gripper system 11. The sealing device 3 may comprise a vertically movable sealing tool bottom part 12 and a sealing tool upper part 13 only partially shown in FIG. 1.

Figure 2:
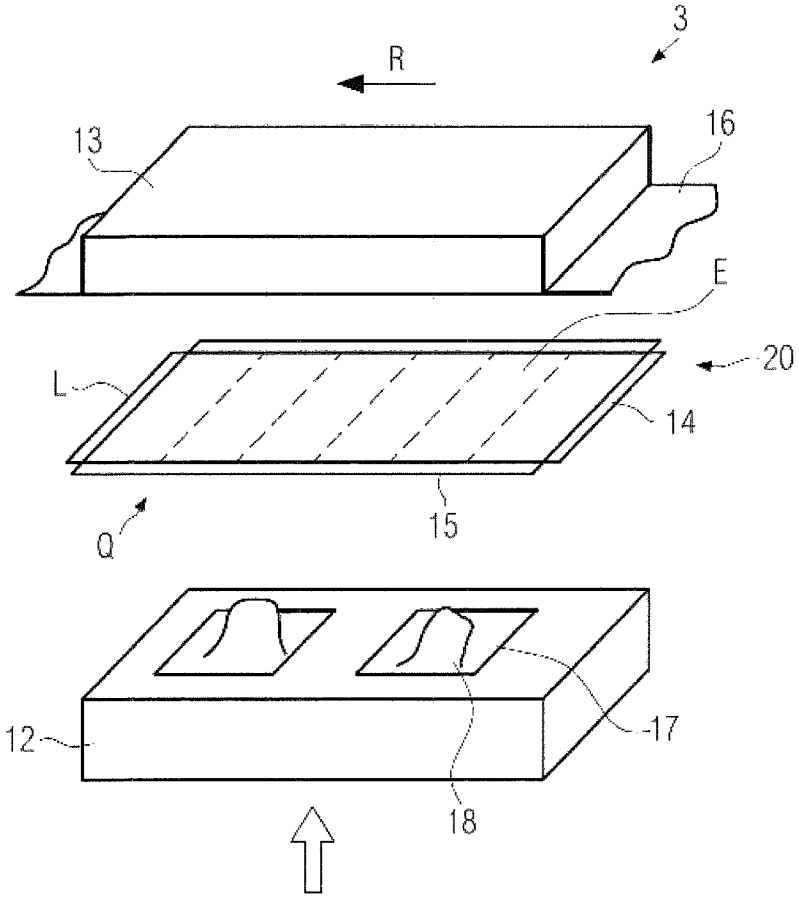
FIG. 2 is a top perspective schematic view of a sealing device according to one embodiment of the present invention.

At the inlet side of the sealing device 3, underneath the sealing tool upper part 13 and underneath a film 16 running along the bottom side of the sealing tool upper part 13, a first monitoring means 14 in the form of a light curtain may be arranged across the width of the sealing tool upper part 13 to monitor a defined area on a plane E in the production direction R (see FIG. 2). A second monitoring means 15 in the form of a light curtain may be arranged in the production direction R laterally of the sealing device 3 across the length of the sealing tool upper part 13 to monitor the defined area on plane E transversely to the production direction R.

On the feed belt 2 or the discharge belt 4, trays 17 are transported into the sealing device 3 or out of it in operation. In the sealing device 3, the trays 1-7 can be evacuated and/or treated with gas, sealed with the film 16, and the film 16 is cut. The film web 16 may be supplied by the film feed roller 9 and guided through the film tensioning device 6. The cut off residual film or the residual film grid can be wound onto the residual film rewinder 10.

The transfer of the trays 17 between the feed belt 2, the sealing station 3 and the discharge belt 4 may be accomplished by the gripper system 11 which comprises two grippers 11*a*, 11*b*. The gripper system 11 is designed such that it takes a group of several trays 17 out of the sealing device 3 and may simultaneously transport another group into it.

The sealing device 3 may include a lifting system which is not represented in greater detail and which lifts the sealing tool bottom part 12 vertically to the top towards the sealing tool upper part 13. The group of trays 17 may be lifted along in the process by the tray's edges of the trays 17 being received in a tray reception which is part of the sealing tool bottom part 12. The trays 17 can be lifted up to the sealing tool upper part 13, and the film 16 can be clamped between the sealing tools 12, 13. In this position of the sealing tools 12, 13 with respect to each other, no foreign matter and no part of the product 18 must be located in principal in the region of the sealing seam or the tray's edge as otherwise no tight sealing seam could be produced any longer. Depending on the type of foreign matter, a sealing tool 12, 13 might also be damaged. Corresponding recesses are provided in the sealing tool upper part 13 for products 18 projecting upwards from the tray's edge of the tray 17, and the film web 16 may be a flexible film. The defined area on plane E, in which monitoring by the first and second monitoring means 14, 15 is accomplished, can be located somewhat underneath the sealing tool upper part 13. To facilitate monitoring, the lifting speed of the sealing tool bottom part 12 may be reduced. The defined area on plane E can have a distance from the sealing tool upper part 13 which permits the control unit 7 to stop the lifting motion of the sealing tool bottom part 12 in case of errors in time before it reaches the sealing tool upper part 13. The distance is preferably smaller than 100 mm, and is optionally even only about 50 mm.

The matrix monitoring device 20 (see FIG. 2) with two monitoring means 14, 15, permits to detect products 18 projecting from the tray's edge of the trays 17, or products, foreign matters and/or a tray's edge itself located on the sealing tool bottom part 12, and to associate their positions in the defined area on plane E. The control unit 7 may compare this detection with the data previously stored in the control unit 7, which describe the specified position of the trays 17 in the sealing tool bottom part 12, and thus may distinguish a product 18 in the tray 17 projecting upwards from other elements and can correspondingly stop the lifting motion of the sealing tool bottom part 12 in case of an error and indicate information on the error to the operator via the operating device or the display 8. The operator may eliminate the cause for the error after the sealing tool bottom part 12 has been lowered. A possible damage to one of the sealing tools 12, 13 may thus be prevented while products 18 projecting upwards from the tray's edge are still packed.

FIG. 2 schematically shows the sealing device 3 with the sealing tool bottom part 12, the defined area on plane E with a matrix monitoring unit 20, the film 16 and the sealing tool upper part 13. In the sealing tool bottom part 12, two trays 17 may be received by means of their edges by the sealing tool bottom part 12, a product 18 projecting upwards from the tray's edge being located in the trays 17. Before the sealing tool bottom part 12 reaches the sealing tool upper part 13 during its lifting motion to the top, it crosses the defined area on plane E which represents the monitoring plane and is generated by the two monitoring means 14, 15. The defined area on plane E, or the sealing device 3, comprises a transverse side Q oriented in the production direction R and a longitudinal side L oriented transversely to the production direction. The first monitoring means 14 can monitor the defined area on plane E across the longitudinal side L, and the second monitoring means 15 can monitor the defined area on plane E across the transverse side. A matrix monitoring device 20 provided in this way may perform an evaluation by means of the control unit 7 which permits the association between the position in the defined area on plane E and a triggering of the monitoring means 14, 15. The time for monitoring can depend on the position of the sealing tool bottom part 12 to the defined area on plane E. In the position that is optimal for this, the sealing tool bottom part 12 or the trays 17 may be located directly under the defined area on plane E to also detect small foreign matters or trays 17 that are not correctly placed in the sealing tool bottom part 12.

Two cameras which monitor the defined area on plane E in the longitudinal and transverse directions to the sealing device 3 are also conceivable.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. Tray-sealing machine comprising:

a sealing device for sealing a film onto a tray conveyed in a production direction, the tray containing a product, the sealing device comprising a sealing tool upper part and a sealing tool bottom part;

a control unit having a memory, said memory storing a data set relating to a position of at least the tray in said sealing tool bottom part; and a matrix monitoring device for monitoring a partial area of a defined area on a plane orthogonal to a vertical lifting motion of the sealing tool bottom part, the matrix monitoring device comprising a first monitor and a second monitor, the first monitor disposed at a height of the plane and at a transverse side of the sealing device to monitor a width distance of the defined area transverse to the production direction, and the second monitor disposed at the height of the plane and at a longitudinal side of the sealing device to monitor a length distance of the defined area in the production, the partial area is determined by said control unit based upon the data set, wherein the partial area comprises the defined area excluding an interior area defined through vertical registration of an inside of an edge of the tray onto said plane, wherein the matrix monitoring device detects at least one of (a) a misalignment of the tray in the sealing tool bottom part, or (b) a presence of foreign matter between the sealing tool bottom part and the sealing tool upper part within the partial area.

2. Tray-sealing machine according to claim 1, wherein the first monitor and the second monitor are one of a light curtain or a camera.

3. Tray-sealing machine according to claim 1, wherein the defined area of the plane is disposed underneath the sealing tool upper part.

4. Tray-sealing machine according claim 3, wherein the defined area of the plane is in vertical registration with a perimeter of the sealing tool upper part.

5. Tray-sealing machine according to claim 1, wherein the control unit is in electronic communication with a lifting device of the sealing tool bottom part and said control unit stops a lifting of the sealing tool bottom part towards the sealing tool upper part when the matrix monitoring device detects at least one of (a) the a misalignment of the tray in the sealing tool bottom part, or (b) the presence of foreign matter between the sealing tool bottom part and the sealing tool upper part within said partial area.

6. Tray-sealing machine according claim 1, wherein the transverse side is perpendicular to the longitudinal side.

7. Tray-sealing machine according claim 1, wherein the partial area includes a peripheral area defined through vertical registration of the edge of the tray onto said plane.

8. Method for operating a tray-sealing machine, the method comprising steps of:

providing a sealing device for sealing a film onto a tray conveyed in a production direction, the tray containing a product, the sealing device comprising a sealing tool upper part and a sealing tool bottom part;

operating a first monitor at a plane height along a width distance in a direction perpendicular to the production direction, the plane being orthogonal to a vertical lifting motion of the sealing tool bottom part;

operating a second monitor at said plane height along a length distance in said production direction, said first monitor and said second monitor comprise a matrix monitoring device, and said width distance and said length distance defining a monitoring area of the plane;

providing a control unit having a memory;

storing a data set in the memory of the control unit, the data set relating to a position of the tray in said sealing tool bottom part;

monitoring a partial area of the monitoring area of the plane, wherein the partial area is determined by said control unit based upon the data set, wherein the partial area comprises the monitoring area excluding an interior area defined through vertical registration of an inside of an edge of the tray onto said plane;

detecting with the matrix monitoring device at least one of (a) a misalignment of the tray in the sealing tool bottom part, or (b) a presence of foreign matter between the sealing tool bottom part and a sealing tool upper part; and distinguishing between said at least one of the misalignment of the tray or and the presence of foreign matter, and said product projecting upwards from the tray by determining whether said at least one of the misalignment of the tray, said presence of foreign matter, or said product projecting upwards from the tray is disposed within said partial area.

* * * * *